US007501772B2

(12) United States Patent
Chung et al.

(10) Patent No.: US 7,501,772 B2
(45) Date of Patent: Mar. 10, 2009

(54) LED LIGHTING STRING EMPLOYING RECTIFIED AND FILTERED DEVICE

(75) Inventors: Wen-Chen Chung, Hsinchu (TW); Chun-Hsien Liu, Hsinchu (TW); Tung-Lung Liu, Hsinchu (TW)

(73) Assignee: Excellence Opto. Inc., Hsinchu (TW)

( * ) Notice: Subject to any disclaimer, the term of this patent is extended or adjusted under 35 U.S.C. 154(b) by 0 days.

(21) Appl. No.: 11/647,338

(22) Filed: Dec. 29, 2006

(65) Prior Publication Data

US 2008/0157686 A1 Jul. 3, 2008

(51) Int. Cl.
*H05B 37/00* (2006.01)

(52) U.S. Cl. ..... 315/185 R; 315/192; 315/200 R; 315/312; 362/545; 362/654; 362/612

(58) Field of Classification Search ..... 315/185 R, 315/185 S, 187, 192, 205, 246, 312, 200 R; 362/543, 545, 612, 653, 654, 800, 806
See application file for complete search history.

(56) References Cited

U.S. PATENT DOCUMENTS

| | | | | |
|---|---|---|---|---|
| 6,072,280 | A * | 6/2000 | Allen | 315/185 S |
| 6,461,019 | B1 * | 10/2002 | Allen | 362/249 |
| 7,250,730 | B1 * | 7/2007 | Allen | 315/185 R |
| 7,276,858 | B2 * | 10/2007 | Allen | 315/205 |
| 2002/0145392 | A1 * | 10/2002 | Hair et al. | 315/185 R |
| 2006/0180822 | A1 * | 8/2006 | Yu | 257/98 |
| 2006/0198143 | A1 * | 9/2006 | Cheung | 362/251 |
| 2007/0138968 | A1 * | 6/2007 | Chang | 315/185 R |
| 2007/0177383 | A1 * | 8/2007 | Tsai | 362/253 |

* cited by examiner

*Primary Examiner*—Haissa Philogene
(74) *Attorney, Agent, or Firm*—Bacon & Thomas, PLLC

(57) ABSTRACT

An improved LED lighting string employs a rectified and filtered device functioned as a low pass filter device to rectify input AC source into DC source providing to the LED lighting string for improving LED's flickering issue and to upgrade the optical power factor and efficiency, and luminous intensity in LED lighting string.

2 Claims, 5 Drawing Sheets

LED LIGHTING STRING EMPLOYING RECTIFIED AND FILTERED DEVICE

BACKGROUND OF THE INVENTION

1. Field of the Invention

The present invention relates to an improved LED lighting string employing a rectified and filtered device to rectify input AC source into DC source, and more particularly to an improved LED lighting string capable of improving LED's flickering issue and optimizing the optical power factor in LED lighting string.

2. Description of the Prior Art

As shown in FIGS. 1 and 2, a current LED lighting string 10 decorated on a Christmas tree or on windows for celebration during the Christmas day or festival every year comprises an electrical wire 11 integrating with a plug 12 to get an AC source and one or more loops of LED lighting string 15 with a predetermined number of LED lamps 15*a* for lighting with single or multiple colors.

It is known a traditional bulb is workable during the positive and negative half-wave when to input AC source into the traditional bulb. While since the LED's characteristic is different from the traditional bulb the LED lamp can work during either positive or negative half-wave only.

Due to the LED having the characteristic of semiconductor, the LED lamps when to apply the AC power source fails to emit lighting during the positive half-wave and negative half-wave simultaneously. Thus, this flaw may cause LED lamp can only work during half-wave, eventually resulting in massive loss to power factor.

In a word, the current LED lighting string 10 shown in FIGS. 1 and 2 obviously exists with the flickering problem, which was mainly caused by the electrical frequency of 60 Hz or 50 Hz workable during either positive or negative half-wave of AC input source. The flickering problem existed in the current LED lighting string 10 will cause consumer with uncomfortable feeling in visual perception during the application.

For solving the flicking problem of the current LED lighting string 10 mentioned above, it needs to design an electrical circuit program to improve the current LED Lighting String in application.

SUMMARY OF THE INVENTION

The primary objective of this present invention is to provide an improved LED lighting string employing an electric circuit program integrating with a rectified and filtered device to rectify input AC source into DC source providing to the LED lighting string, with this rectified and filtered device the LED lighting string may improve LED's flickering issue to generate "flicker free LED" in the LED lighting string and may upgrade the optical power factor and efficiency, and luminous intensity in LED lighting string.

The main feature of the improved LED lighting string of the present invention comprises an electrical wire integrating with a plug to get an AC source and one or more loops of LED lighting strings in parallel circuit each loop having a predetermined number of LED lamps for lighting with single or multiple colors, wherein each loop or at least one loop of LED lighting strings has a rectified and filtered device coupled to the plug to rectify input AC source into DC source providing to the loop of LED lighting string having one corresponding rectified and filtered device.

Another feature of the improved LED lighting string of the present invention is that each loop or at least one loop of LED lighting strings further has one or more safe LED bulbs as a current-limiting device in series circuit to stabilize the corresponding loop applied in the improved LED lighting string of the present invention.

Further another feature of the improved LED lighting string of the present invention is that at least one loop of LED lighting strings has an end connector used as a device connecting the other strings and a rectified and filtered device coupled to the end connector.

DESCRIPTION OF THE PREFERRED EMBODIMENT

Figure 1:
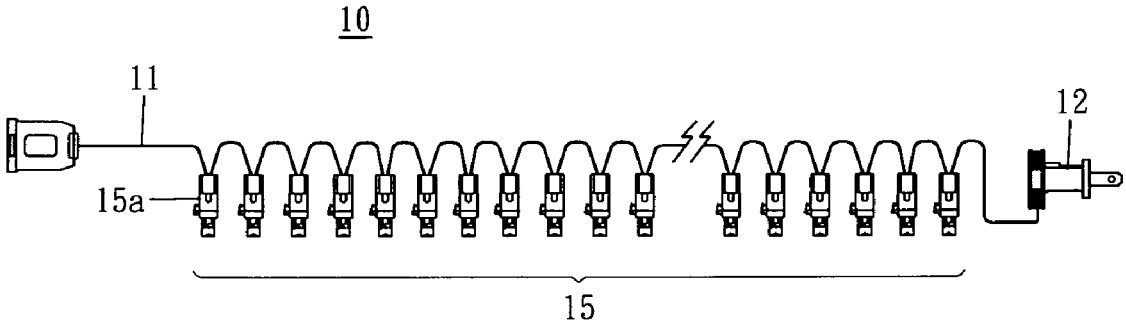
Fig. 1 (prior art)
FIG. 1 is a schematic view for a current LED lighting string which employs AC source existing with the problem of flickering.
Figure 2:
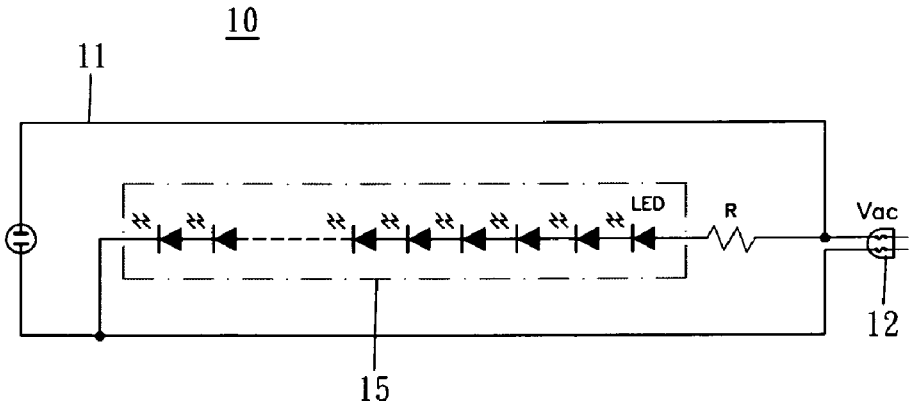
Fig. 2 (prior art)
FIG. 2 is an electric circuit diagram for the current LED lighting string showing in FIG. 1.
Figure 3:
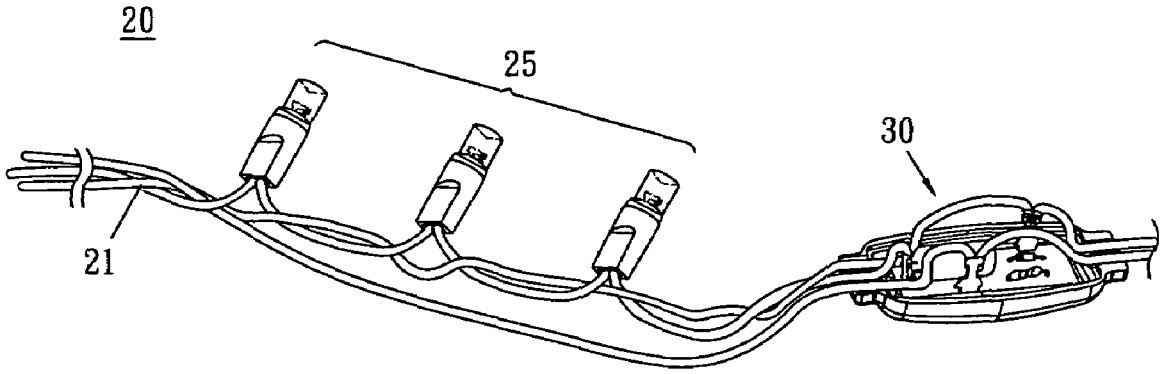
FIG. 3 is a perspective view for a LED lighting string of the present invention having a rectified and filtered device to rectify the input AC source into DC source to improve the problem of flickering.

Referred to from FIG. 3 to FIG. 6, the first embodiment of an improved LED lighting string 20 of the present invention comprises an electrical wire 21 integrating with a plug 22 to get an AC source, one loop of LED lighting string 25 with a predetermined number of LED lamps 25*a* for lighting with single or multiple colors and a rectified and filtered device 30 coupled in between the plug 22 and the loop of LED lighting string 25 to rectify input AC source into DC source providing to the loop of LED lighting string 25.

Figure 4:
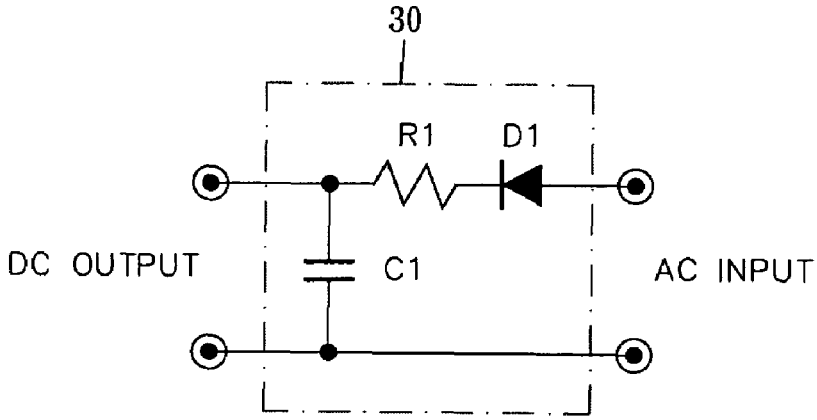
FIG. 4 is an electric circuit diagram for the rectified and filtered device showing in FIG. 3 having the function of rectifying input AC source into DC source.
Figure 5:
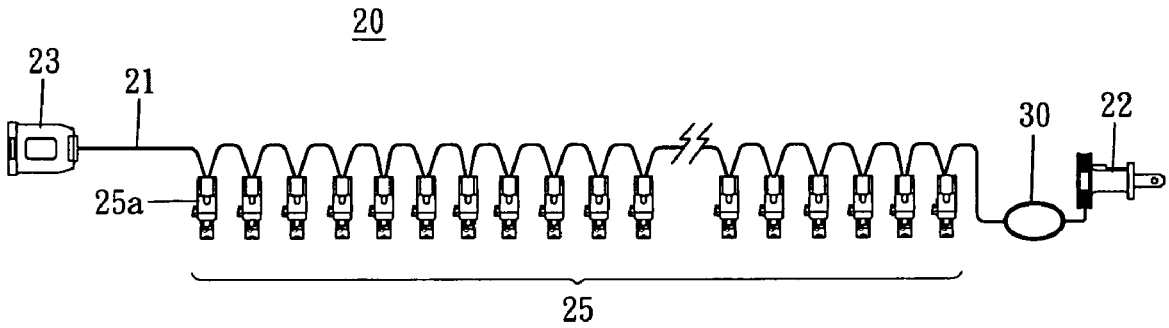
FIG. 5 is a schematic view to the LED lighting string of the present invention with a rectified and filtered device showing in FIG. 3.
Figure 6:
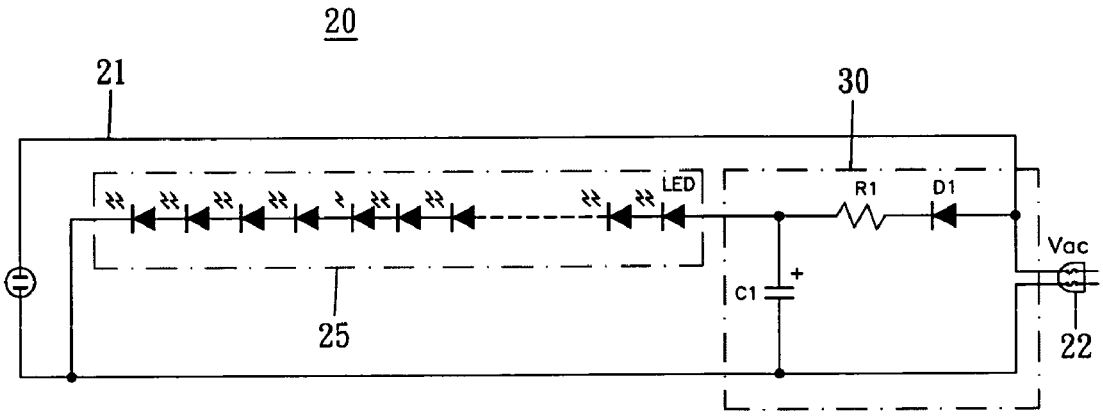
FIG. 6 is an electric circuit diagram for the LED lighting string of the present invention with a rectified and filtered device showing in FIG. 3.

The electric circuit program applied to the rectified and filtered device 30 is shown as FIG. 4, which integrates a diode D1, a resistor R1 and a capacitor C1 as a "low pass filter" device. When AC is input to the rectified and filtered device 30, the input AC is processed through the diode D1 for rectification, and then gone through the resistor R1 and the capacitor C1 to rectify and filter input current with ripple and output DC. Thus the rectified and filtered device 30 has the function of rectifying an AC input source into a DC output source and providing the rectified and efficient DC source into the LED lighting string 25 of the present invention.

When inserting the plug 22 of the improved LED lighting string 20 of the present invention into an AC source, an input AC power is then supplied to the rectified and filtered device 30 of the improved LED lighting string 20. After then, the workable function done from the rectified and filtered device 30 is further explained as follows:

1. When AC input power is at positive half-wave, the diode D1 may work and let the current pass through diode D1 and the resistor R1 and charge to capacitor C1, the charged maximum value may be up to the peak value of Vp, wherein Vp=Vc;

2. When AC input value is less than the charged voltage in capacitor C1, the diode D1 may not work and the capacitor C1 may work to discharge electricity according to the time-factor RC via the load R of the LED lighting string 25;

3. The capacitor C1 continues to discharge electricity until when AC input value is larger than the discharged voltage in capacitor C1, at the time, the diode D1 may work, and the capacitor C1 may be charged up to Vp and continue to next circle as mentioned above;

4. Accordingly, the above cycles may keep each LED light 25*a* of the LED lighting string 25 workable all the time during the positive or negative half-wave of AC input power.

By employing this rectified and filtered device 30, it is concluded that the LED lighting string 25 of the improved LED lighting string 20 of the present invention may improve LED's flickering issue to generate "flicker free LED" in the LED lighting string 25 and may upgrade the optical power factor and efficiency, and luminous intensity in LED lighting string 25.

Figure 7:
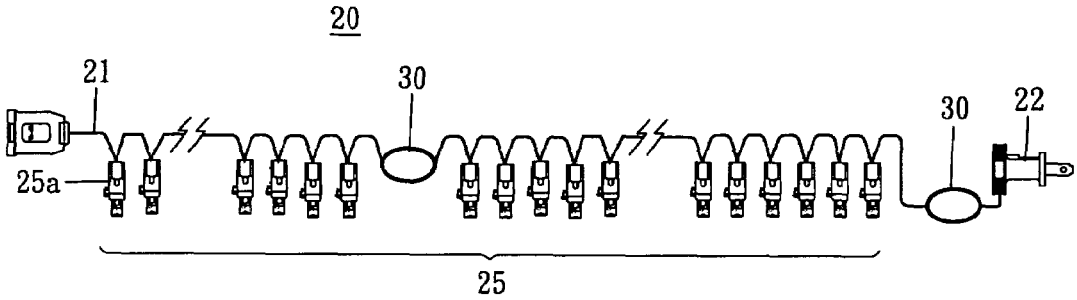
FIG. 7 is a schematic view to show a second embodiment of LED lighting string of the present invention.
Figure 8:
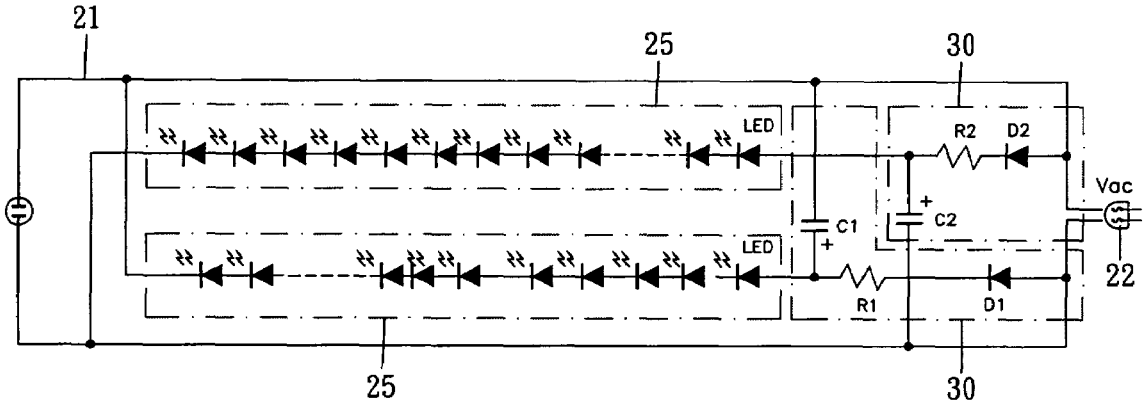
FIG. 8 is an electric circuit diagram for the second embodiment of LED lighting string of the present invention showing in FIG. 7.

A second embodiment of the improved LED lighting string 20 of the present invention is shown as in FIGS. 7 and 8, which fundamental structure is identical to the first embodiment mentioned above but comprising more than one loop of LED lighting strings 25 in parallel circuit, wherein each loop or at least one loop of LED lighting strings 25 has a rectified and filtered device 30 coupled to the plug 22 to rectify input AC source into DC source providing to the loop of LED lighting string 25 having one corresponding rectified and filtered device 30.

Figure 10:
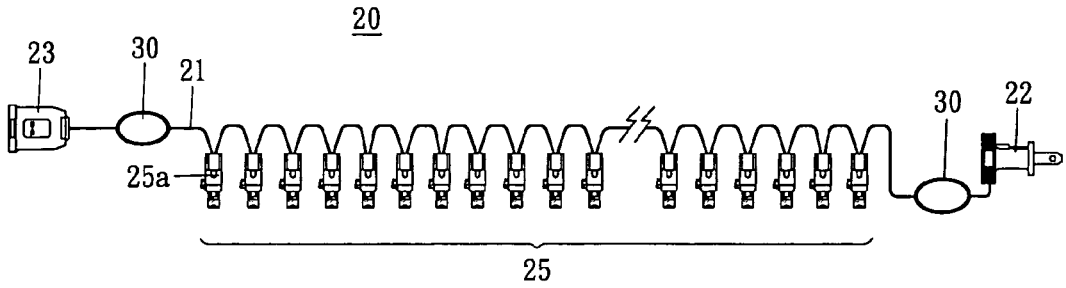
FIG. 10 is a schematic view to show a third embodiment of LED lighting string of the present invention.
Figure 11:
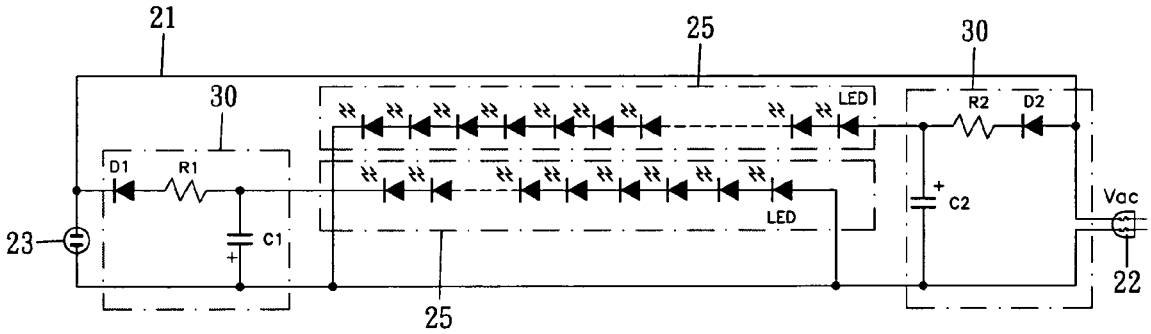
FIG. 11 is an electric circuit diagram for the third embodiment of LED lighting string of the present invention showing in FIG. 10.

A third embodiment of the improved LED lighting string 20 of the present invention is shown as in FIGS. 10 and 11, which fundamental structure is identical to the first embodiment mentioned above but comprising more than one loops of LED lighting strings 25 in parallel circuit, wherein at least one loop of LED lighting strings 25 has an end connector 23 used as a device connecting the other loop of LED lighting string 25 and a rectified and filtered device 30 coupled in series circuit to the end connector 23 for providing a DC source.

Figure 9:
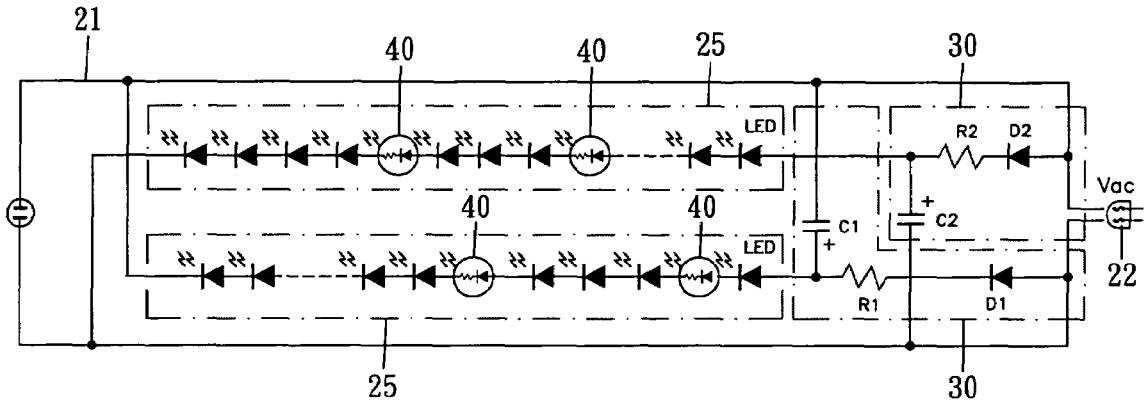
FIG. 9 is another electric circuit diagram for the second embodiment of LED lighting string of the present invention of FIG. 7 which has one or more safe LED bulbs to control LED lamps as a current-limiting device applied in the LED Lighting string.
Figure 12:
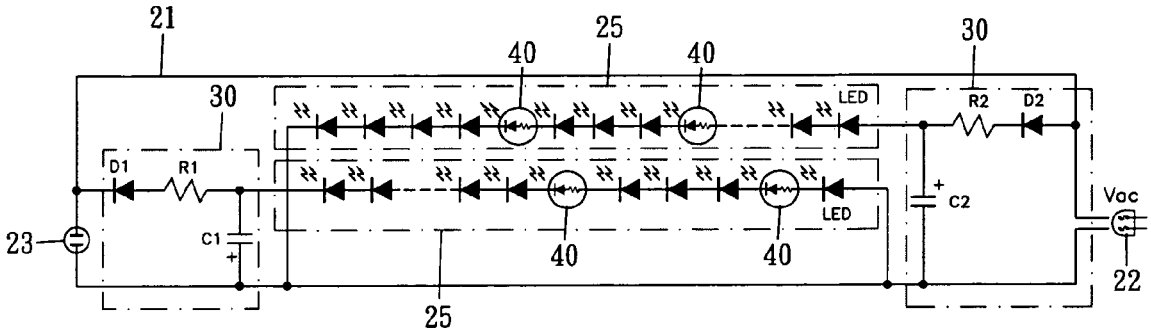
FIG. 12 is another electric circuit diagram for the third embodiment of LED lighting string of the present invention of FIG. 10 which has one or more safe LED bulbs to control LED lamps as a current-limiting device applied in the LED Lighting string.

As shown in FIG. 9 or 12, another feature for the first, the second or the third embodiment of the improved LED lighting string 20 of the present invention is that to achieve current-limiting purpose each loop or at least one loop of LED lighting strings 25 further has one or more safe LED bulbs 40 as a current-limiting device in series circuit to stabilize the corresponding loop of LED lighting strings 25 applied in the improved LED lighting string 20 of the present invention.

The contents disclosed above relate to a preferred embodiment of the present invention. It is to be understood that all equivalent modifications, variations, improvement or changes that are easily made by skillful people in the trade and without departing from the spirit of the above contents and drawings should be included in the subject claim.

What is claimed is:

1. An improved LED lighting string designed to improve LED's flickering problems, comprises an electrical wire and one or more loops of LED lighting strings in parallel circuit integrated with a plug to connect with an AC source, and an end connector used for connecting the other loop of LED lighting string, wherein each loop or multiple loops of LED lighting strings has/have a half-wave rectified and filtered device integrated with a diode D1, a resistor R1 and a capacitor C1 as a low pass filter device and coupled to the plug to rectify the inputted AC source into a DC source.

2. The improved LED lighting string as defined in claim 1, wherein each loop or at least one loop of LED lighting strings further has one or more safe LED bulbs as a current-limiting device.

* * * * *